US005330318A

United States Patent [19]

Ogawa

[11] Patent Number: 5,330,318

[45] Date of Patent: Jul. 19, 1994

[54] CENTRIFUGAL PUMP WITH AN IMPROVED AXIAL DIFFUSOR

[75] Inventor: Motoyasu Ogawa, Tokyo, Japan

[73] Assignee: Nikkiso Co., Ltd., Tokyo, Japan

[21] Appl. No.: 36,732

[22] Filed: Mar. 25, 1993

[30] Foreign Application Priority Data

May 28, 1992 [JP] Japan ..... 4-136795

[51] Int. Cl.[5] ..... F04D 29/44

[52] U.S. Cl. ..... 415/1; 415/181; 415/199.3; 415/208.2; 415/211.2

[58] Field of Search ..... 415/1, 181, 191, 199.2, 415/199.3, 208.1, 208.2, 211.2

[56] References Cited

U.S. PATENT DOCUMENTS 2,097,390 10/1937 DeMey ..... 415/208.2
4,938,661 7/1990 Kobayashi et al. ..... 415/199.3

FOREIGN PATENT DOCUMENTS 55-84898 6/1980 Japan .
61-31700 2/1986 Japan .
181525 6/1922 United Kingdom .
604121 6/1948 United Kingdom .

OTHER PUBLICATIONS

Patent Abstracts of Japan, vol. 4, No. 128 (M-31) (610), Sep. 9, 1980.
Patent Abstracts of Japan, vol. 10, No. 187 (M-493) (2243), Jul. 2, 1986.

*Primary Examiner*—Edward K. Look
*Assistant Examiner*—Christopher Verdier
*Attorney, Agent, or Firm*—Young & Thompson

[57] ABSTRACT

The invention provides a centrifugal pump having an axial diffusor with plural blades having such a specific incident angle as to prevent appearance of revolving and stall of a treating liquid. An incident angle of the blades of the axial diffusor is selected so that the value obtained by subtracting from the blade incident angle a treating liquid incident angle is equal to or below a specific angle representative of the kind of treating liquids.

4 Claims, 4 Drawing Sheets

CENTRIFUGAL PUMP WITH AN IMPROVED AXIAL DIFFUSOR

BACKGROUND OF THE INVENTION

The invention relates to a centrifugal pump with an axial diffusor for a treating liquid, and more particularly to an improvement in an axial diffusor with a plurality of blades having such an incident angle as to prevent revolving and stalling to occur at an inlet portion of the diffusor.

The structure of a conventional centrifugal pump with the axial diffusor will be described with reference to FIG. 1.

In general, the centrifugal pump is provided with an impeller 10, an axial diffusor 12 with a plurality of blades 16. The impeller 10 is engaged with a rotation shaft 22 through a key 11 so as to rotate around a rotation axis together with the rotation shaft 22 where a treating liquid 14 exhibits an increase in its flow rate. In contrast, the axial diffusor is so secured through a slide bearing 19 to the rotation shaft 22 that the axial diffusor 12 with the plurality of blades 16 does not rotate around the rotation axis. Each of the blades 16 is placed at its one side on a side portion of the axial diffusor. Each of the blades 16 is placed at its opposite side on an inner wall of a casing 20. The treating liquid 14 is subjected to a flow straightening by the blades 16 of the axial diffusor 12 where the treating liquid exhibits a reduction of the flow rate and an increase in its pressure.

Such axial diffusor pump suffers from the following undesirable phenomenon concerning the flow of the treating liquid. When the treating liquid flows through the blade 16 of the axial diffusor 12 and thus is subjected to the flow rate reduction and the pressure rise, the following undesirable phenomenon occurs. When the discharge flow rate is in a high flow rate range, the effects of the flow rate reduction and the pressure rise are normally exhibited by the blades 16 of the axial diffusor 12. However, when the discharge flow rate is in a low flow rate range, the above normal effects of the flow rate reduction and the pressure rise are not exhibited. In replacement of the normal phenomenon, the treating liquid exhibits a revolving and a stall at the inlet portion of the axial diffusor 12. Such revolving and stall phenomenon causes a violent axial vibration which reduces the life-expectancy of the slide bearing 19. FIG. 2 illustrates a head-discharge curve. Further, this makes the flow rate and head property inferior thereby lowering the pump efficiency. The revolving and the stall at the inlet portion of the axial diffusor 12 also cause an increase likelihood of hunting. Actually, the available operational flow rate range of the pump is restricted by a generation of the revolving and the stall of the treating liquid.

SUMMARY OF THE INVENTION

Accordingly, it is an object of the present invention to provide a centrifugal pump with an improved axial diffusor with blades having such an incident angle so as to prevent revolving and stalling from occurring at an inlet portion of the axial diffusor.

The above and other objects, features and advantages of the present invention will be apparent from the following descriptions.

The present invention provides an axial diffusor with blades which has such an incident angle as to prevent the revolving and stall from occurring at the inlet portion of the axial diffusor in which a subtractive value by an incident angle of the treating liquid from the blade incident angle is in the range form −1° to 8° and the blade incident angle is in the range from 3° to 10° . In the present invention, the centrifugal pump with the axial diffusor with the improved blades having the incident angle of 3° to 10° is so operated that the subtractive value by the incident angle of the treating liquid from the blade incident angle is in the range form −3° to 8°. Alternatively, the centrifugal pump with the axial diffusor with the improved blades is so operated that the subtractive value by the incident angle of the treating liquid from the blade incident angle is in the range form −1° to 8° when the incident angle of the treating liquid is in the range from 0.1° to 2°.

In the axial diffusor centrifugal pump, the incident angle of the blade of the axial diffusor is variably determined so as to prevent the revolving and stall to occur at the inlet portion of the axial diffusor.

BRIEF DESCRIPTION OF THE DRAWINGS

Preferred embodiments of the present invention will hereinafter fully be described in detail with reference to the accompanying drawings.

PREFERRED EMBODIMENTS OF THE INVENTION

Figure 1:
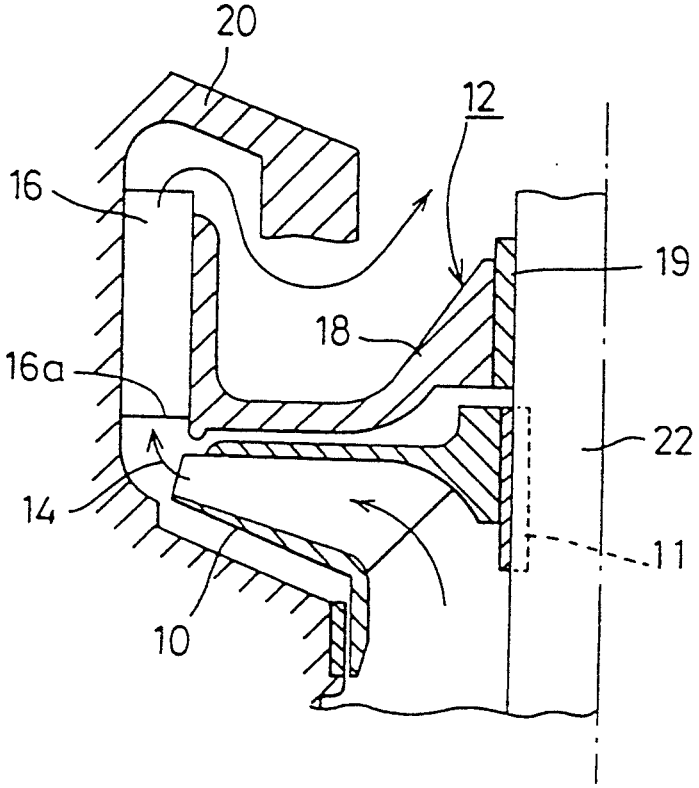
FIG. 1 PRIOR ART
FIG. 1 is a fragmentary cross sectional elevation view illustrative of the axial diffusor with blades and the impeller in the centrifugal pump in the prior art.
Figure 2:
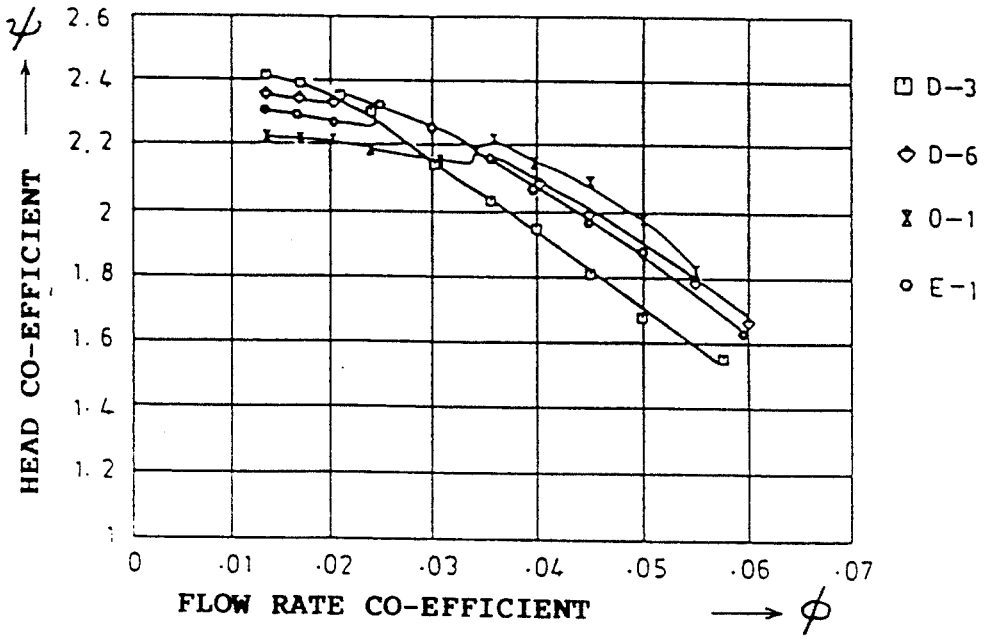
FIG. 2 PRIOR ART
FIG. 2 is a diagram illustrative of the head-discharge curve of the head coefficient versus the flow rate coefficient.

A preferred embodiment according to the present invention will be described. The present invention provides a novel centrifugal pump with an improved axial diffusor with blades, which has the same structure as that of the prior art illustrated in FIG. 1, except for a specific angle of the blade of the axial diffusor. The structure of the centrifugal pump with the axial diffusor will thus be described with reference to FIG. 3.

The centrifugal pump has an impeller 10 and an axial diffusor 12. The axial diffusor 12 comprises a body 18, a plurality of blades 16 placed on a side portion of the diffusor body 18 and a casing 20 accommodating both the impeller 10 and the axial diffusor 12. The impeller 10 is engaged with a rotation shaft 22 through a key so as to exhibit a rotation together with the rotation shafts 22. The impeller 10 has an opening serving as an inlet port for the treating liquid at its top portion. The treating liquid is introduced through the opening of the impeller 10 into the impeller 10 for receipt of a flow rate rising. Subsequently, the treating liquid is introduced into the axial diffusor 12 so as to flow through the blades 16 arranged on the side portion of the axial diffusor 12 where the treating liquid receives the flow straightening from the blades 16 whereby an increase in the pressure and a decrease in the flow rate of the treating liquid occur.

Figure 4:
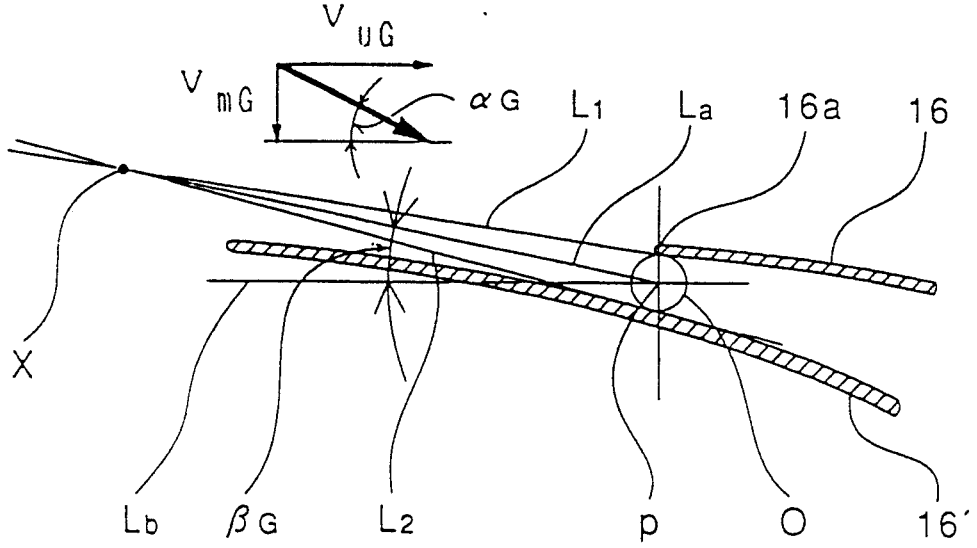
FIG. 4 is a fragmentary cross sectional elevation view illustrative of an inlet portion of blades of an improved axial diffusor in a novel centrifugal pump of a first embodiment according to the present invention.

The blades 16 of the axial diffusor 12 have a specific incident angle $\beta_G$ which will be described in detail with reference to FIG. 4 illustrative of first and second blades 16 and 16' adjacent to each other. The incident angle $\beta_G$ of the blades 16 and 16' is defined by an included angle formed by a line $L_a$ and a line $L_b$ where the line $L_a$ includes both a center point P of an inscribed circle O between the first and second blades 16 and 16' and an intersection point X of tangential lines $L_1$ and $L_2$ of the first and second blades 16 and 16', and the line $L_b$ is a peripheral line of the axial diffusor 12 extending in a vertical plane to the longitudinal axis of the rotation shaft 22 of axial diffusor 12. An incident angle $\alpha_G$ of the treating liquid is defined by both a peripheral velocity $V_{uG}$ of the inlet portion 16a of the blade 16 and a meridian velocity $V_{mG}$ of the treating liquid at the inlet portion 16a of the first blade 16 where the meridian velocity $V_{mG}$ has been subjected to a compensation as a function of the thickness of the blade 16 or 16'. The treating liquid incident angle $\alpha_G$ is given by the following equation.

$$\alpha_G = \tan^{-1}(V_{mG}/V_{uG})$$

A stagger angle $\theta$ defined by the difference $(\beta_G - \alpha_G)$ between the blade incident angle $\beta_G$ and the treating liquid incident angle $\alpha_G$ is selected so as to be equal to or below a specific angle which is approximately 7° to 8° whereby the revolving of the treating liquid is prevented. Preferably, the specific angle is approximately 7° when the treating liquid is water. When the treating liquid is a liquefied gas, the specific angle is suitably approximately 8°.

Figure 5:
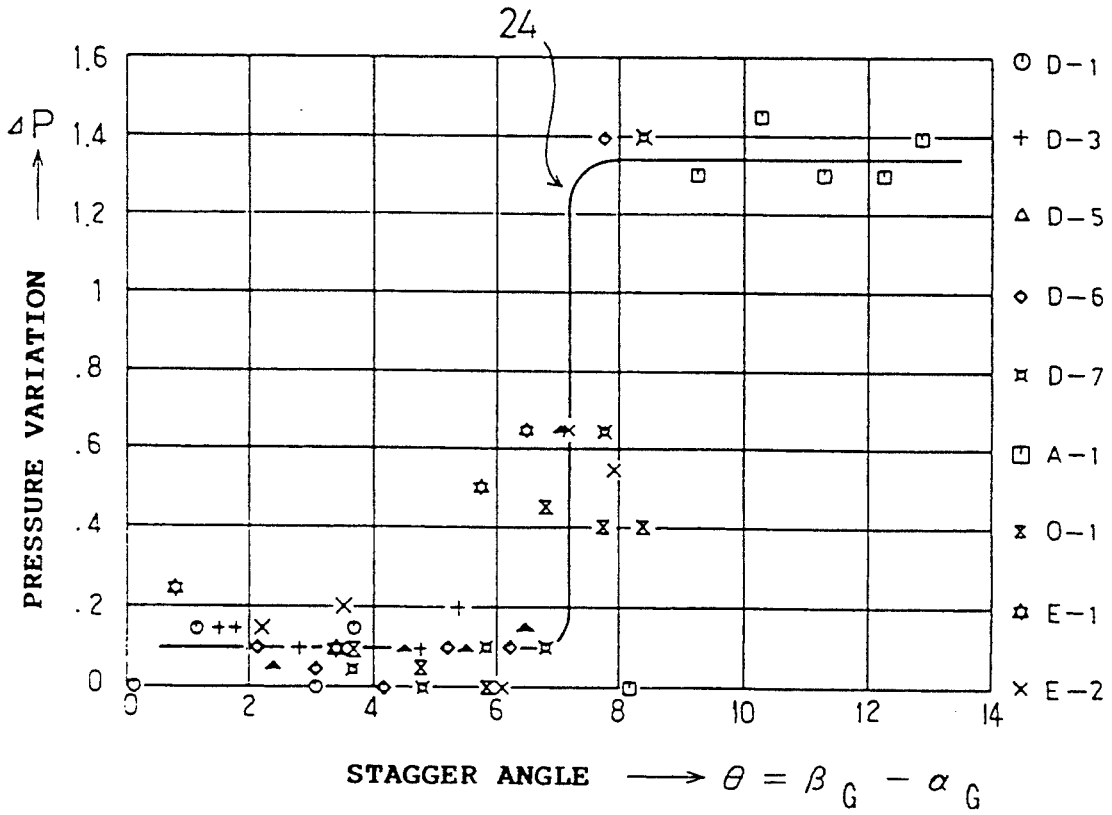
FIG. 5 is a diagram illustrative of a blade property of pressure variation versus a stagger angle.
Figure 6:
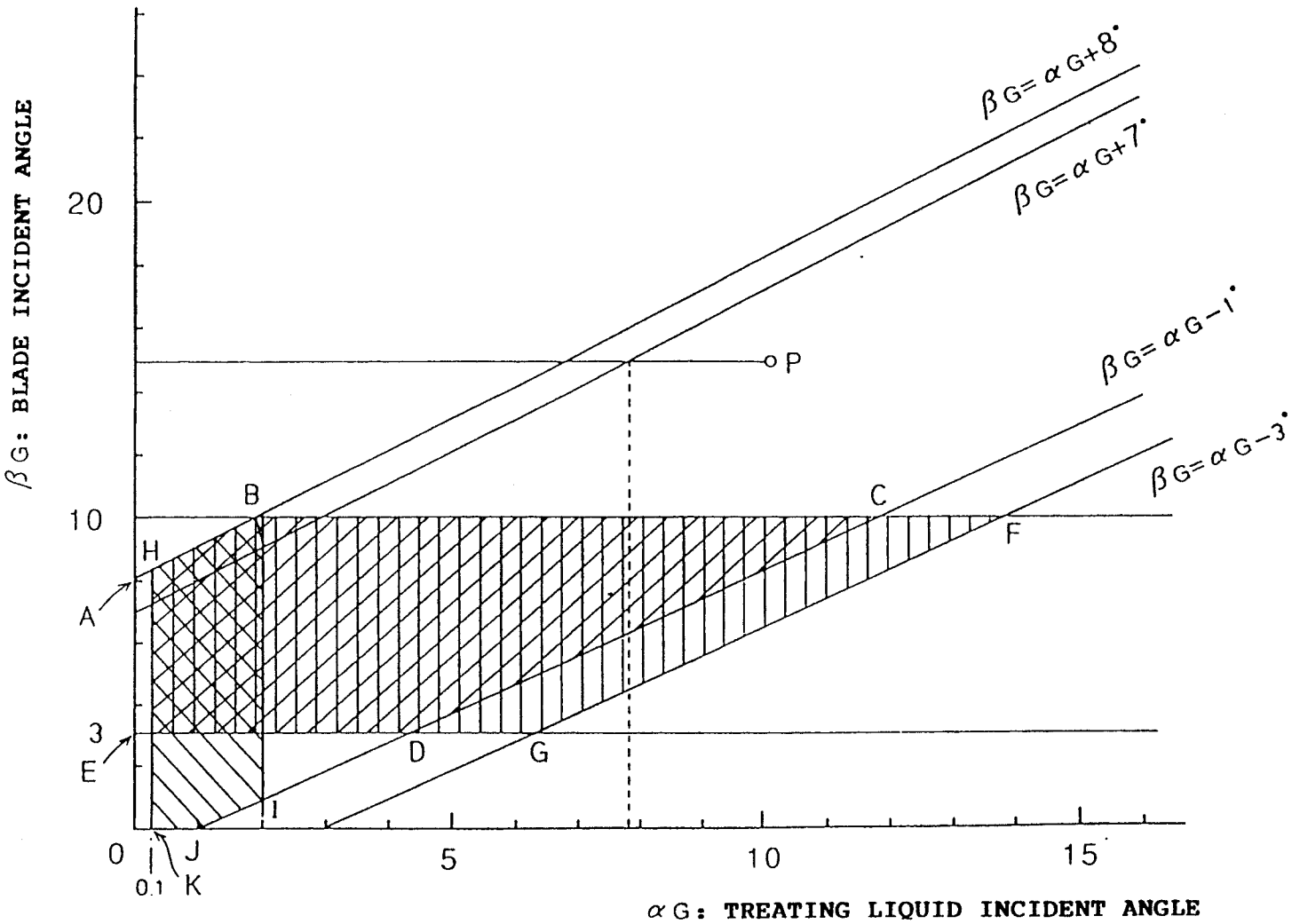
FIG. 6 is a diagram illustrative of a property of a blade incident angle versus an incident angle of the treating liquid.

Results of examination and measurement concerned with the flow of the treating liquid at the inlet portion 16a of the blades 16 of the axial diffusor 12 will be described with reference to FIG. 5 and TABLE 1. The examination has been conducted under the following conditions which are represented in TABLE 1.

TABLE 1

| DIFFUSOR | $d_G$ (mm) | $b_G$ (mm) | $Z_G$ | $\beta_G$ (°) |
|---|---|---|---|---|
| D-1 | 15.4 | 17.1 | 4 | 4.0 |
| D-3 | 16.1 | 17.1 | 4 | 6.5 |
| D-5 | 21.0 | 17.1 | 4 | 8.2 |
| D-6 | 24.5 | 17.1 | 4 | 8.9 |
| D-7 | 27.9 | 17.1 | 4 | 9.5 |
| A-1 | 17.7 | 17.1 | 8 | 14.0 |
| O-1 | 15.7 | 17.1 | 8 | 9.5 |
| E-1 | 13.8 | 14.0 | 8 | 7.7 |
| E-2 | 14.3 | 14.0 | 8 | 9.3 |

$d_G$: a diameter of the inscribed circle
$b_G$: a height of the blades
$Z_G$: the number of blades
$\beta_G$: the incident angle of blades The examination in case of each of the above nine types of the axial diffusors was conducted in a water testing machine. FIG. 5 illustrates a pressure variation curve 24 of pressure variation $\Delta P$ versus the stagger angle $\theta$ as the results of the examination. The pressure variation curve 24 teaches that the pressure variation $\Delta P$ rapidly increased at a stagger angle $\theta$ of approximately 7°. This indicates that the revolving and stall of the treating liquid occur at a stagger angle $\theta$ of approximately 7°.

On the other hand, in the case of a liquefied gas, the pressure variation $\Delta P$ rapidly increased at a stagger angle $\theta$ of approximately 8°, although the illustration of the pressure variation curve in this case is omitted. This indicates that the revolving and stall of the treating liquid occur at a stagger angle $\theta$ of approximately 8°.

From the above results, it is clear that the occurrence of the revolving and stall of the treating liquid is a function of the stagger angle $\theta$. The stagger angle $\theta$ depends upon the particular treating liquid. Thus, the stagger angle is calculated so as to prevent the occurrence of a rapid increase of the pressure variation thereby making it possible to suppress the occurrence of the revolving and stall of the treating liquid. This makes the available flow rate range wide. In addition, since the incident angle $\alpha_G$ of the treating liquid is a function of the discharge flow rate of the treating liquid of the pump, the measurement of the incident angle property of the blade 16 in the normal axial diffusor permits an expectation of a critical flow rate at which rate the revolving and stall of the treating liquid begins to occur.

Figure 3:
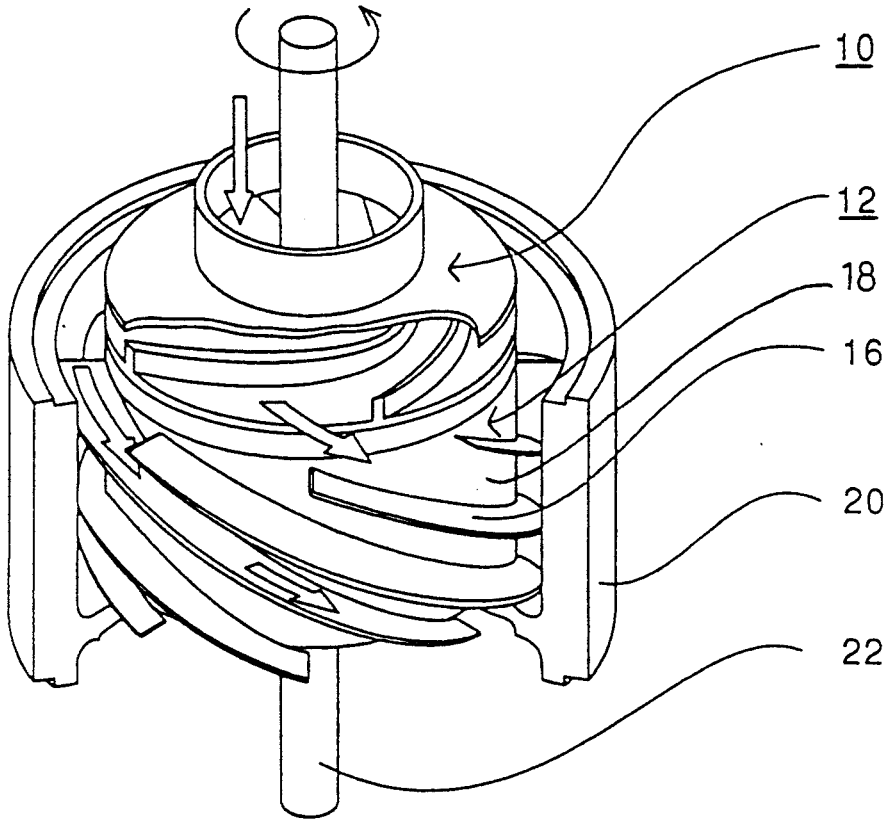
FIG. 3 is a fragmentary perspective view illustrative of an improved axial diffusor with blades and an impeller in a novel centrifugal pump of a first embodiment according to the present invention.

FIG. 3 expresses a relation between the blade incident angle $\beta_G$ and the treating liquid incident angle $\alpha_G$. When values of both the treating liquid incident angle $\alpha_G$ and the blade incident angle $\beta_G$ take a point below lines labeled by $\beta_G = \alpha_G + 8°$, and $\beta_G = \alpha_G + 7°$, neither the revolving nor stall of the treating liquid occurs. In contrast, when the values of both the treating liquid incident angle $\alpha_G$ and the blade incident angle $\beta_G$ take a point above-mentioned the above lines, the revolving and stall of the treating liquid appear. When the blade incident angle $\beta_G$ and the treating liquid incident angle $\alpha_G$ are respectively 15° and 10° as illustrated by a point P, the revolving and the stall do not appear so that the axial diffusor is able to exhibit the normal performance. When the treating liquid incident angle $\alpha_G$ is lowered by closing a discharge valve and then approaches an angle range below 8°, the tendency of the revolving and stall of the treating liquid begins to occur.

It is preferable that the centrifugal pump with the axial diffusor 12 having a blade incident angle $\beta_G$ of 3° to 8° is driven at such a treating liquid incident velocity that the stagger angle $\theta$ is between −3° to 8°. Further, it is suitable that when the treating liquid incident angle $\alpha_G$ is in the range from 0.1° to 2°, the centrifugal pump is.so driven that the stagger angle $\theta$ takes −1° to 8°.

The blade incident angle $\beta_G$ and the thickness, height and the number of blades are variably so determined as to match various conditions.

Whereas modifications of the present invention will no doubt be apparent to a person having ordinary skill in the art, to which the invention pertains, it is to be understood that the embodiments shown and described by way of illustrations are by no means intended to be considered in a limiting sense. Accordingly, it is to be intended to cover by claims all modifications which fall within the sprit and scope of the invention.

What is claimed is:

1. A driving method for a centrifugal pump having an axial diffusor with a plurality of blades, comprising driving said pump such that a blade incident angle is in the range from 3° to 10° and a value obtained by subtracting from said blade incident angle a treating liquid incident angle is in the range from −3° to 8°.

2. A driving method for a centrifugal pump having an axial diffusor with a plurality of blades, comprising driving said pump so that a treating liquid incident angle is in the range from 0.1° to 2° and a value obtained by subtracting from a blade incident angle said treating liquid incident angle is in the range from −1° to 8°.

3. An axial diffusor for a centrifugal pump comprising a body having a side portion and a plurality of blades, characterized in that a blade incident angle is in the range from 3° to 10° and a value obtained by subtracting from said blade incident angle a treating liquid incident angle is in the range from −1° to 8°.

4. A centrifugal pump having an axial diffusor with a plurality of blades, characterized in that a blade incident angle is in the range from 3° to 10° and a value obtained by subtracting from said blade incident angle a treating liquid incident angle is in the range from −1° to 8°.

* * * * *